United States Patent [19]

Beach

[11] Patent Number: 4,739,887

[45] Date of Patent: Apr. 26, 1988

[54] REMOTE CONTROL ORGANIZER RACK

[76] Inventor: Gordon E. Beach, 11921 W. Dodson St., Zion, Ill. 60099

[21] Appl. No.: 910,963

[22] Filed: Sep. 24, 1986

[51] Int. Cl.[4] ..... A47F 7/00

[52] U.S. Cl. ..... 211/13; 211/187

[58] Field of Search ..... 211/134, 144, 13, 187, 211/42, 43, 86, 78, 77; 108/102, 103; 312/350

[56] References Cited

U.S. PATENT DOCUMENTS

| | | | |
|---|---|---|---|
| 3,433,364 | 3/1969 | Chen | 211/144 X |
| 3,716,282 | 2/1973 | Propst et al. | 312/350 X |
| 4,140,223 | 2/1979 | Rau et al. | 211/78 |
| 4,502,741 | 3/1985 | DeVries et al. | 312/350 X |
| 4,505,059 | 3/1985 | Morris | 211/78 X |
| 4,519,656 | 5/1985 | Raz | 211/86 X |
| 4,596,195 | 6/1986 | Wenger | 312/350 X |

*Primary Examiner*—Robert W. Gibson, Jr.
*Attorney, Agent, or Firm*—Gilden & Israel

[57] ABSTRACT

A rack is specially designed for holding stereo and television remote control devices. The rack includes horizontally adjustable shelves and may further include either a fixed or swivel base. The rack also includes a special holder for a television guide book or the like.

7 Claims, 3 Drawing Sheets

FIG 2
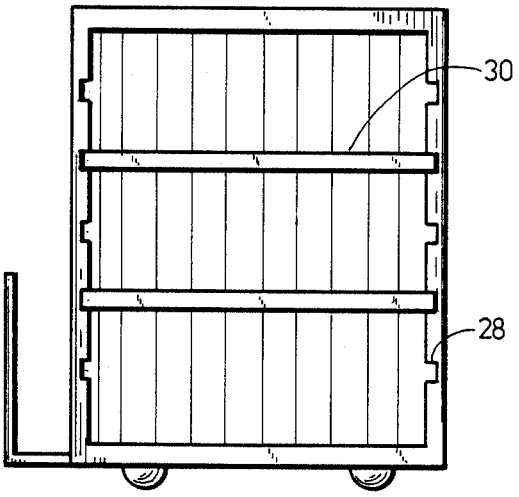
FIG 3
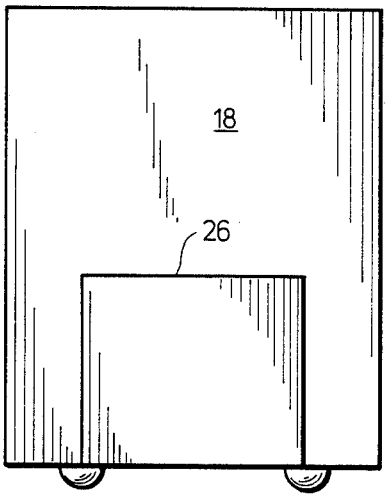
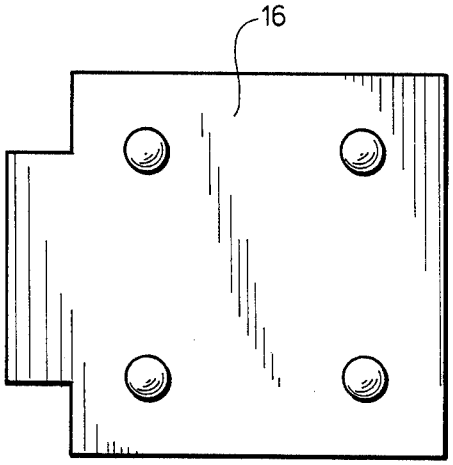
FIG 6

FIG 7
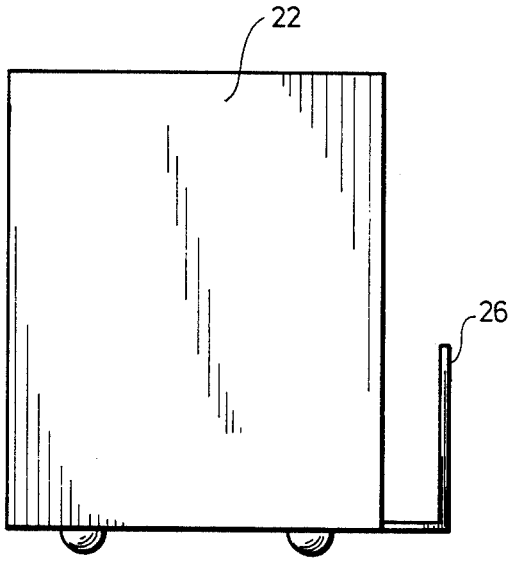
FIG 4
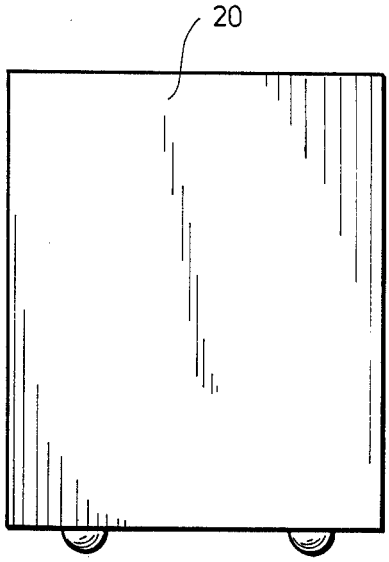
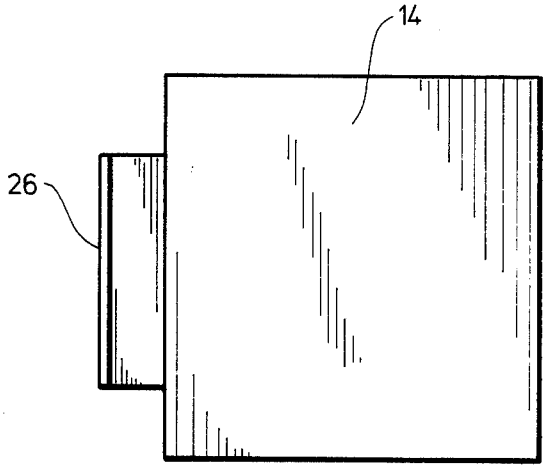
FIG 5

REMOTE CONTROL ORGANIZER RACK

BACKGROUND OF THE INVENTION

1. Field of the Invention

The present invention relates to storage racks, and more particularly pertains to a new and improved rack for holding stereo and television remote control devices.

2. Description of the Prior Art

The prior art is replete with various types of racks for holding virtually any conceivable item. Many of these racks are mounted on swivel bases, while also having variously positioned vertical and horizontal support shelves. A typical prior art rack is to be found in U.S. Pat. No. 3,433,364, which issued to T. Chen on Mar. 18, 1969. The rack disclosed in this patent is effectively a revolving foldable bookstand and includes a plurality of vertical supports for retaining books on a top planar surface of the rack. This rack is illustrative of a far greater number of patented racks, with the particular novelty of each of the racks residing in their support shelf positioning for holding particular unique items. More specifically, the Chen rack is specially designed to hold books, and would not be particularly useful for holding other types of items, although other items could be supported thereby.

Another innovative rack is disclosed in U.S. Pat. No. 3,889,817, which issued to J. Berkman on June, 1975. The rack disclosed in this patent includes a generally square-shaped supporting surface with four dividing walls radiating outwardly from the center. Slots are provided in the walls for receiving magnetic tape cartridges. As can be appreciated, this rack is essentially similar to the above-discussed rack; however, its most functional and efficient use is for the storage of magnetic tape cartridges. Other items stored on the rack would not fit properly thereon, and it is unlikely that such other uses of the rack would be anticipated by an owner.

As such, it can be appreciated that there are literally hundreds of designs for racks which initially appear substantially similar, while their functional utility is limited therebetween to certain shaped and sized items. More particularly, the storage of different items requires differently designed racks. Although numerous rack designs are currently commercially available, there are apparently no specially designed racks for holding stereo and television remote control devices and as such, it would appear that there exists a need for such a specially designed rack structure. In this respect, the present invention substantially fulfills this need.

SUMMARY OF THE INVENTION

In view of the foregoing disadvantages inherent in the known types of support racks now present in the prior art, the present invention provides an improved support rack construction wherein the same is particularly designed for the storage of stereo and television remote control devices. As such, the general purpose of the present invention, which will be described subsequently in greater detail, is to provide a new and improved support rack which has all the advantages of the prior art support rack constructions and none of the disadvantages.

To attain this, the present invention comprises a substantially rectangularly shaped rack structure having a plurality of horizontally adjustable shelves The shelves are retained within slots formed within the box-like rack housing, with the shelves being slidably removable and repositionable to obtain the desired height adjustment. As such, the storage capacity between shelves can be varied to accommodate the various sized remote control devices now available for the control of stereo apparatuses and televisions.

Additionally, the rack structure may include either a fixed or swivel base, while a side positioned slot may be provided for holding a television guide or the like. If desired, a carrying handle can be attached to a topmost surface of the rack to facilitate a transporting thereof.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved support rack which has all the advantages of the prior art support racks and none of the disadvantages.

It is another object of the present invention to provide a new and improved support rack which may be easily and efficiently manufactured and marketed.

It is a further object of the present invention to provide a new and improved support rack which is of a durable and reliable construction.

An even further object of the present invention is to provide a new and improved support rack which is susceptible of a low cost of manufacture with regard to both materials and labor, and which accordingly is then susceptible of low prices of sale to the consuming public, thereby making such support racks economically available to the buying public.

Still yet another object of the present invention is to provide a new and improved support rack which provides in the apparatuses and methods of the prior art some of the advantages thereof, while simultaneously overcoming some of the disadvantages normally associated therewith.

Still another object of the present invention is to provide a new and improved support rack which is particularly designed for the storage of stereo and television remote control devices.

Yet another object of the present invention is to provide a new and improved support rack which includes horizontally adjustable shelves.

Those together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a front elevation view thereof.

FIG. 3 is a left side elevation view of the invention.

FIG. 4 is a right side elevation view of the present invention.

FIG. 5 is a top plan view of the present invention.

FIG. 6 is a bottom plan view of the invention.

FIG. 7 is a rear elevation view of the present invention.

DESCRIPTION OF THE PREFERRED EMBODIMENTS

Figure 8:
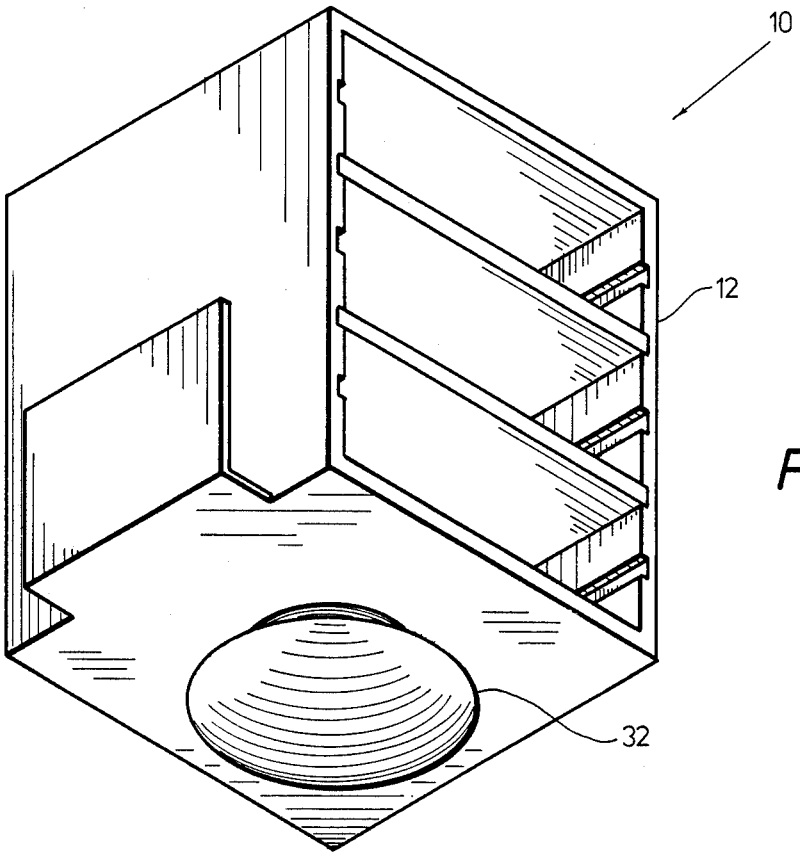
FIG. 8 is a bottom perspective view of a modified embodiment of the invention.

With reference now to the drawings, and in particular to FIGS. 1–7 thereof, a new and improved support rack embodying the principles and concepts of the present invention and generally designated by reference numeral 10 will be described.

More specifically, it will be noted that the support rack 10 essentially comprises a rectangularly-shaped housing 12. In this respect, the housing 12 is formed of integral or separable planar surfaces which form a top surface 14, a bottom surface 16, left and right respective vertical sidewalls 18, 20, and a vertical rear wall 22. In the separable construction, the planar sections 14–22 may be attached together by any conventional means, such as through the use of glue, threaded fasteners, or the like, to thereby form the aforementioned housing 12.

Further illustrated in the drawings is a plurality of downwardly extending, surface contacting supports 24, which could be formed of a flexible rubber-like material to prevent abrasive damage to furniture and the like. The supports 24 can vary in number and can be constructed of any conceivable material which would perform the desired function, while the supports may be attached to the housing 12 by any conventional means as above-mentioned.

Figure 1:
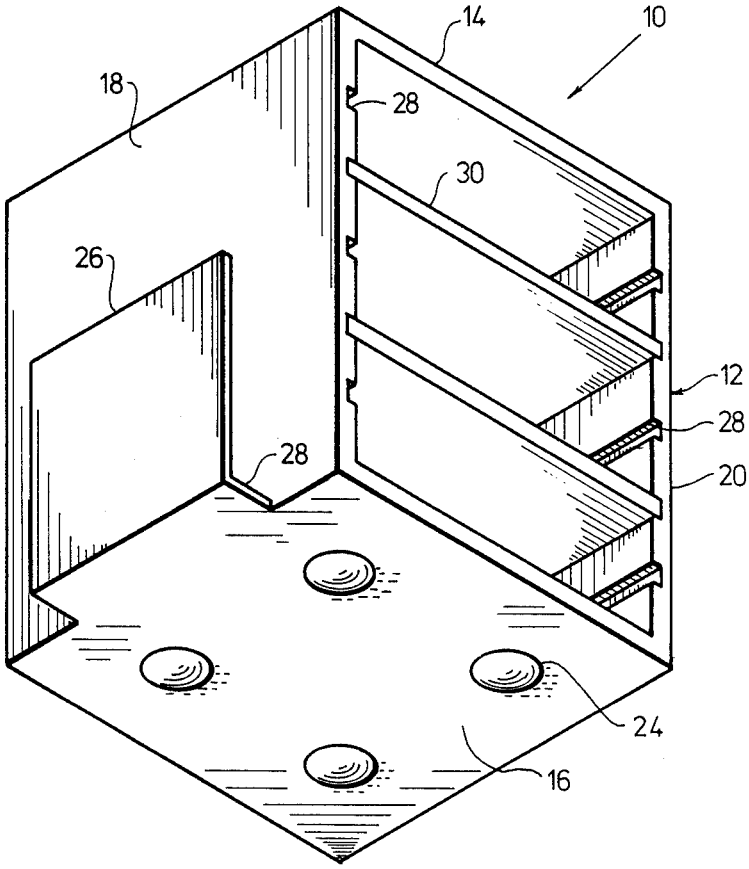
FIG. 1 is a rear perspective view of a first embodiment of the remote control organizer rack comprising the present invention.

As best illustrated in FIGS. 1 and 2, a further upstanding planar support 26 may be attached to a bottommost portion of the sidewall 18. The planar section 26 may be integrally or otherwise attached to the wall 18 by a horizontal section 28, thereby to define a slot between the walls 18, 26. The slot formed by the walls 18, 26 is particularly well designed for receiving and supporting a television guide or some other similar publication.

As is also best illustrated in FIGS. 1 and 2, interior portions of the sidewalls 18, 20 are provided with parallelly-aligned inwardly extending slots 28 which are designed to slidingly receive and support a plurality of horizontally positioned shelves 30. The shelves 30 may be removed from the housing 12 when desired and may be repositioned therein in any pair of chosen slots 28, to thus vary the storage space between adjacent shelves. As such, storage space adjustability is provided to facilitate various sizes of remote control devices.

FIG. 8 of the drawings illustrates a modified embodiment of the invention wherein the surface supports 24 have been replaced with a single swivel base 32. The swivel base 32 is rotatable relative to the housing 12 and may be attached thereto by any conventional means. The swivel base 32 allows a rotation of the housing 12 to facilitate access to various remote control devices contained therein.

With respect to the manner of usage and operation of the present invention 10, such usage and operation should be apparent from the above description. Accordingly, no further discussion relative thereto will be provided.

With respect to the above description then, it is to realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved rack for storing stereo and television remote control devices, said rack comprising:

housing means;

horizontally adjustable shelves positioned in said housing means, said shelves being provided to support said stereo and television remote control devices; and upstanding planar support means fixedly secured to a sidewall of such said housing means.

2. The new and improved rack for storing stereo and television remote control devices as described in claim 1, wherein said horizontally adjustable shelves are sidlingly positioned in said housing means.

3. The new and improved rack for storing stereo and television remote control devices as described in claim 2, wherein said horizontally adjustable shelves are slidingly retained within horizontally aligned slots provided on opposite interior sidewalls of said housing means.

4. The new and improved rack for storing stereo and television remote control devices as described in claim 3, wherein said upstanding planar support means is designed to retain a publication.

5. The new and improved rack for storing stereo and television remote control devices as described in claim 3, and further including base support means fixedly secured to a bottom exterior surface of said housing means.

6. The new and improved rack for storing stereo and television remote control devices as described in claim 5, wherein said base support means includes a plurality of fixedly secured supports.

7. The new and improved rack for storing stereo and television remote control devices as described in claim 5, wherein said base support means includes a swivel support, thereby to permit relative rotative movement between said base support means and said housing means.

* * * * *